US006487762B1

(12) United States Patent
Fleissner

(10) Patent No.: US 6,487,762 B1
(45) Date of Patent: Dec. 3, 2002

(54) METHOD AND DEVICE FOR COLOR PATTERNING OF A WEB BY HYDRODYNAMIC TREATMENT

(75) Inventor: Gerold Fleissner, Zug (CH)

(73) Assignee: Fleissner GmbH & Co., Maschinenfabrik, Egelsbach (DE)

( * ) Notice: Subject to any disclaimer, the term of this patent is extended or adjusted under 35 U.S.C. 154(b) by 29 days.

(21) Appl. No.: 09/716,281

(22) Filed: Nov. 21, 2000

(30) Foreign Application Priority Data

Nov. 24, 1999 (DE) ..... 199 56 571

(51) Int. Cl.[7] ..... D06B 1/02; D06B 5/08; D06C 23/00

(52) U.S. Cl. ..... 28/104; 28/163; 28/167

(58) Field of Search ..... 28/103, 104, 105, 28/106, 107, 109, 163, 167, 160, 158; 442/408, 384, 389; 428/85, 89, 90, 91, 92, 97

(56) References Cited

U.S. PATENT DOCUMENTS 2,970,365 A * 2/1961 Morgenstern ..... 28/112
3,214,819 A * 11/1965 Guerin ..... 28/104
3,506,530 A * 4/1970 Crosby ..... 28/111
3,705,064 A * 12/1972 Lochner ..... 28/109
3,725,166 A * 4/1973 McCord ..... 156/148
3,819,465 A * 6/1974 Parsons et al. ..... 28/109
4,144,366 A * 3/1979 Lewis ..... 28/109
4,146,663 A * 3/1979 Ikeda et al. ..... 28/104
4,211,593 A * 7/1980 Lochner ..... 28/109
4,519,804 A * 5/1985 Kato et al. ..... 442/408
4,691,417 A * 9/1987 Vuillaume ..... 28/105
4,948,649 A * 8/1990 Hiers et al. ..... 28/107
5,153,056 A * 10/1992 Groshens ..... 28/104
5,175,042 A * 12/1992 Chomarat ..... 28/104
5,405,650 A * 4/1995 Boulanger et al. ..... 28/104
5,632,072 A * 5/1997 Simon et al. ..... 28/163
5,737,813 A * 4/1998 Sternlieb et al. ..... 28/163

* cited by examiner

*Primary Examiner*—Amy B. Vanatta
(74) *Attorney, Agent, or Firm*—Antonelli, Terry, Stout & Kraus, LLP

(57) ABSTRACT

It is known to produce a colored pattern by a printing process or for example during weaving. The idea according to the invention is to produce a pattern by the water jets of a needling device in which, for colored patterning of a web-shaped nonwoven or a composite made of a nonwoven and a fabric or knit, the webs resting on a substrate moves past a nozzle beam located crosswise to the transport direction and are impacted by the water jets. The nonwoven provided as the upper layer of two layers is provided with one or more colors or is colored or printed itself and is placed on a second nonwoven or a woven or one that has a different color. Then both layers are subjected to the water jets that displace the fibers, with the colored fibers in the first layer being displaced into the second layer to produce a pattern on the underside of the second layer. It is also possible, instead of colored fibers in the nonwoven of the upper layer, to move them when they are not colored into a second layer that can have any color.

26 Claims, 1 Drawing Sheet

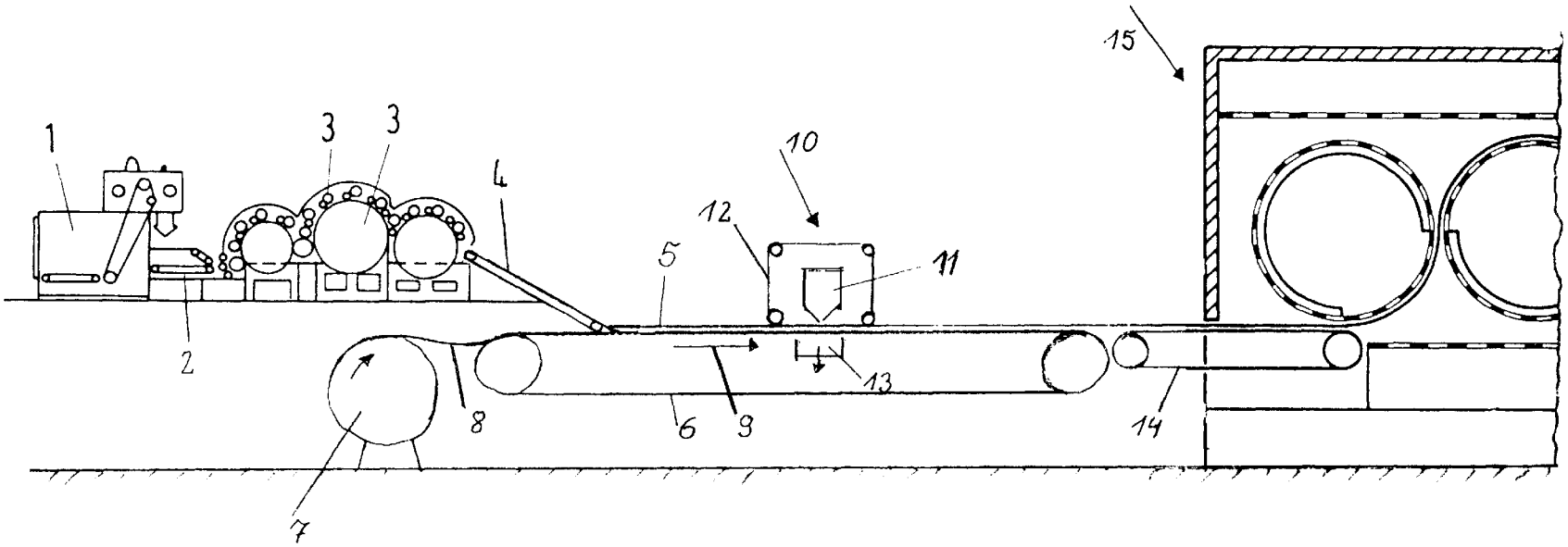
1
2
3
3
4
5
6
7
8
9
10
11
12
13
14
15

METHOD AND DEVICE FOR COLOR PATTERNING OF A WEB BY HYDRODYNAMIC TREATMENT

BACKGROUND OF THE INVENTION

The invention relates to a method for colored patterning of a web-shaped nonwoven or a composite of a nonwoven and a fabric or knit by means of hydrodynamic needling, with the web lying on a substrate and moving past a nozzle beam arranged crosswise to the transport direction and impacted by the water jets.

A method of this kind is known from WO 89/09850. According to this document, a colored web is guided over a plane provided with a three-dimensional pattern and impacted by water jets to produce a washed-out effect on the initially off-color inking.

A pattern without inking is possible using hydrodynamic treatment when, according to U.S. Pat. No. 4,691,417 or EP-A-0 400 349, the water jets are directed at the web of goods such as a nonwoven through a sheet with a perforated pattern. The water jets, as viewed over their area, impact the fibers of the web of goods only partially and displace it only there to form a pattern similar to a watermark.

DISCLOSURE OF THE INVENTION

The goal of the invention is to find a method for achieving a colored patterning of a web of goods, in which a pattern results from hydrodynamic treatment which has the desired colors and pattern types and sizes, without having to be alert for washing-out effects.

Taking its departure from the method of the type mentioned at the outset, the invention provides as a solution to the stated goal that a nonwoven provided with one or more colors or dyed or printed is chosen as the upper layer of two layers, and this nonwoven is placed on a second nonwoven or woven or one having a different color and both layers are subjected to the water jets which displace the fibers. The colored fibers of the first layer are displaced into the second layer to produce a pattern on the underside of the second layer.

The nonwoven in the first layer can come directly in front of a card and has fine fibers of one or different colors. When these fibers are subjected to the water jets, they are moved into and through the second layer. Hence, not only the known solidification of the webs alone and with one another takes place but the fibers of the first nonwoven reach the underside of the second web of goods and produce a pattern of some type there because of their own color. This pattern can be influenced in a wide variety of different ways.

A color pattern according to the invention can also be produced by the second web being produced with dyed fibers for example instead of the dyed fibers of the first nonwoven and then for example white fibers in the first nonwoven penetrate to the back of the colored second nonwoven by the water needling and there they produce a pattern of some type on the underside. This pattern can be influenced in a wide variety of different ways as well.

To produce a pattern oh the back of the second web of goods with the fibers of the first nonwoven, it is important for these fibers to be readily movable by the water jets, in other words for them to have a fine titer such as 1–6 dtex in diameter and a finite length of 20 to 100 mm. In any case, the first nonwoven is non-solidified and is a light card nonwoven. The second web, on the other hand, can also be a nonwoven but it can be pre-solidified by mechanical needling for example or it can be a weave or a knit that forces a definable direction of the fibers penetrating from the first nonwoven by its internal thread structure. This is typical of the pattern that can be produced on the underside. It is also important in this regard, from what fibers the second web is produced: Their thickness, properties, and the strength of the thread structure of the second web are important.

Quite different color patterns can be produced if a third means for steering the water jets in a desired direction is added. This means can be located in front of or between the two layers or even below the second web. If the element is located between the webs, it is obvious that it remains permanently in the total product. It is different if for example the water jets are aimed at the first nonwoven by an endless belt or drum that is permeable with a pattern that unrolls directly on the nonwoven. The partially colored fibers of the first nonwoven are partially transported through the second web so that it is only at these places that coloration of the back of the second web or patterning takes place.

BRIEF DESCRIPTION OF THE DRAWING

A device for working the method according to the invention is shown as an example in the drawing. It consists only of the details in the device that are known of themselves. The FIGURE shows a continuous system for making a patterned nonwoven with final drying.

DETAILED BRIEF DESCRIPTION OF THE PREFERRED EMBODIMENT

First, the lightweight nonwoven on top is made of polyester fibers and/or polypropylene fibers and/or natural fibers. A card 1–4 is used as the nonwoven laying device. The card consists of a weighing hopper 1 with a vibrating slide 2 located beneath which transfers the fibers of the card spread out uniformly over the width with the scratching and toothed rollers 3. The following endless belt 4 transfers the loosely formed nonwoven 5 to endless belt 6. The latter already carries a nonwoven or fabric or knit pulled off roller 7 and marked 8 which moves together with the endless belt 6 in the direction of arrow 9 to needling station 10.

Needling station 10 receives a composite of two superimposed webs 5 and 8. In order to be able to produce a color pattern on the underside of web 8 by the water jets of beam 11, either nonwoven 5 consists of colored fibers and/or web 8 is made of colored fibers, but of a different color. The web can be white or colored and the colors in webs 5 or 8 are selected accordingly. The first web in any case is a nonwoven 5; the second web 8 can also be one but it can also be a fabric or knit.

The fibers of the nonwoven are moved through second web 8 by the water jets of beam 11 which must impact nonwoven 5 with greater energy (more than 200 and preferably 350 bars for example) with the fibers of the nonwoven being moved through the second web 8 to its rear side lying on belt 6. Depending on the structure of web 8 or endless belt 6 or the steering of the water jets above web 8 or web 5, a different color pattern is produced on the back of web 8. The design of the pattern can be influenced especially well if an element is used for the purpose that steers the water jets. This can be the endless belt 12 shown, a correspondingly located drum, the shape of endless belt 6, or a layer that remains within the composite. Endless belt 12 or the corresponding drum can be a braided fabric or be made of a sheet perforated with a desired pattern. It is only at the holes in endless belt 12 that are open to allow the water to pass through or in the drum that the fibers of nonwoven 5 can move into web 8. Consequently, it is only at these places on the back of web 8 that the fiber composition can change that produces the desired pattern.

After dewatering by suction 13 which can also be performed downstream from needling station 10, the web is guided through endless belt 14 into screen drum dryer 15.

What is claimed is:

1. A method for colored patterning of a web-shaped nonwoven or a composite of a nonwoven and a fabric or knit, comprising:

placing a first layer comprising a nonwoven with one or more colors on a second layer of nonwoven or woven;

transporting the first layer and the second layer on a substrate in a transport direction past a nozzle beam arranged crosswise to the transport direction; and subjecting the first layer and the second layer to water jets from the nozzle beam that displace fibers, with colored fibers of the first layer being displaced into the second layer to produce a pattern on an underside of the second layer.

2. A method according to claim 1, wherein the second layer comprises a nonwoven that is pre-solidified or mechanically pre-needled before it is combined with the first layer.

3. A method according to claim 1, wherein the color pattern is influenced by the structure of the second layer.

4. A method according to claim 1, wherein the color pattern is influenced by the composition of the fibers and by the nature of properties of the fibers in the first and/or the second layer.

5. A method according to claim 1, wherein the pattern is produced by the shape of an element that determines the distribution of the water jets on the web.

6. A method according to claim 5, wherein the element produces its effects between the nozzle beam and the first layer or between the first and second layers.

7. A method according to claim 1, wherein the pattern is influenced by the shape of the substrate that supports the first and second layers.

8. A method according to claim 1, wherein the water jets impact the fibers of the first layer with pressures of more than 150 bars.

9. A method according to claim 1, wherein the energy of the water jets is dimensioned as a function of the weight of the first layer.

10. The method according to claim 1, wherein the first layer is dyed or printed.

11. The method according to claim 1, wherein the second layer has a different color than the first layer.

12. A method according to claim 1, wherein the water jets impact the fibers of the first layer with pressures of 250 to 600 bars.

13. The method according to claim 1, wherein the first layer is a nonwoven of 30 to 100 g/m$^2$ and the water jets impact the fibers of the first layer with pressures up to 150 bars.

14. A method for colored patterning of a web-shaped nonwoven or composite of nonwoven and a fabric or a knit comprising, placing a first layer comprising an uncolored nonwoven on a second layer of nonwoven or woven;

transporting the first layer and the second layer on a substrate in a transport direction past a nozzle beam arranged crosswise to the transport direction; and subjecting the first layer and the second layer to water jets that displace fibers, with uncolored fibers of the first layer being displaced into the second layer to produce a pattern on an underside of the second layer.

15. The method according to claim 14, wherein the first layer comprises white fibers.

16. The method according to claim 14, wherein the second layer comprises colored fibers.

17. A method according to claim 14, wherein the second layer comprises a nonwoven that is pre-solidified or mechanically pre-needled before it is combined with the first layer.

18. A method according to claim 14, wherein the color pattern is influenced by the structure of the second layer.

19. A method according to claim 14, wherein the color pattern is influenced by the composition of the fibers and by the nature of properties of the fibers in the first and/or the second layer.

20. A method according to claim 14, wherein the pattern is produced by the shape of an element that determines the distribution of the water jets on the web.

21. A method according to claim 20, wherein the element produces its effects between the nozzle beam and the first layer or between the first and second layers.

22. A method according to claim 14, wherein the pattern is influenced by the shape of the substrate that supports the first and second layers.

23. A method according to claim 14, wherein the water jets impact the fibers of the first layer with pressures of more than 150 bars.

24. A method according to claim 14, wherein the energy of the water jets is dimensioned as a function of the weight of the first layer.

25. A method according to claim 14, wherein the water jets impact the fibers of the first layer with pressures of more than 250 to 600 bars.

26. The method according to claim 14, wherein the first layer is a nonwoven of 30 to 100 g/m$^2$ and the water jets impact the fibers of the first layer with pressures up to 150 bars.

* * * * *